US005140120A

United States Patent [19]

Kasai et al.

[11] Patent Number: 5,140,120

[45] Date of Patent: Aug. 18, 1992

[54] AUTOMATIC HEATING APPARATUS HAVING A SYSTEM FOR SENSING THE TEMPERATURE OF HEATED AIR GENERATED BY MATERIAL BEING HEATED

[75] Inventors: Isao Kasai, Nabari; Kimiaki Yamaguchi; Takashi Kashimoto, both of Nara; Koji Yoshino, Kyoto, all of Japan

[73] Assignee: Matsushita Electric Industrial Co., Ltd., Kadoma, Japan

[21] Appl. No.: 519,230

[22] Filed: May 3, 1990

[30] Foreign Application Priority Data

May 8, 1989 [JP] Japan ..... 1-114707
May 8, 1989 [JP] Japan ..... 1-114708
May 8, 1989 [JP] Japan ..... 1-114710

[51] Int. Cl.[5] ..... H05B 6/68

[52] U.S. Cl. ..... 219/10.55 B; 219/10.55 E; 219/400; 126/21 A

[58] Field of Search ..... 219/10.55 B, 10.55 R, 219/10.55 E, 400, 490; 126/21 A, 21 R; 99/325

[56] References Cited

U.S. PATENT DOCUMENTS 4,618,756 10/1986 Schwaderer et al. ..... 219/10.55 R
4,672,180 6/1987 Kusunoki et al. ..... 219/494
4,841,111 6/1989 Kokkeler et al. ..... 219/10.55 B
4,857,685 8/1989 Vigano et al. ..... 219/10.55 B
5,015,812 5/1991 Kasai et al. ..... 219/10.55 B

FOREIGN PATENT DOCUMENTS 526052 7/1981 Australia .
528472 6/1982 Australia .
561335 1/1983 Australia .
0289000 11/1988 European Pat. Off. .

*Primary Examiner*—Philip H. Leung
*Attorney, Agent, or Firm*—Spencer, Frank & Schneider

[57] ABSTRACT

A heating and cooking apparatus has a detection sensor for sensing the state of heating so as to automatically control the heating operation. A partition is disposed so as to be opened to the inside of an auxiliary passage which has an inlet located at a position in the vicinity of the circumference of an impeller of a cooling fan for cooling a magnetron provided on the back side of a heating chamber and through which steam from the heating chamber is discharged to the outside. Air supplied by the fan is blown off into the auxiliary passage so as to generate a venturi action, thus promoting the flow of steam in the auxiliary passage. The detection sensor is disposed in the auxiliary passage at a position in the vicinity of a region where air is blown off so as to accurately sense the state of steam generated from a material to be heated.

15 Claims, 7 Drawing Sheets

AUTOMATIC HEATING APPARATUS HAVING A SYSTEM FOR SENSING THE TEMPERATURE OF HEATED AIR GENERATED BY MATERIAL BEING HEATED

BACKGROUND OF THE INVENTION

The present invention relates to an automatic heating apparatus having a sensing system which senses steam of elevated temperature generated from a heated material in accordance with the state of heating, and which controls a heating source in response to a detection signal delivered from the sensing system.

Various types of heating apparatus incorporating a system for automatically sensing the finish of heating of a heated material have hitherto been put into practice. The sensing system of such conventional automatic heating apparatus uses most generally, as a sensing element, a humidity sensor which senses a change in the humidity. However, since the humidity sensor serves to sense a change in the electric resistance of the sensor caused by molecules of water adsorbed on the surface of the sensor a complicated structure and operation have been required such that the contamination on the surface of the element is burnt away periodically with the use of a heater in order to maintain a stable performance over a long time while avoiding any deterioration in the sensitivity or the like attributable to contamination of the surface of the sensor.

On the other hand, we have proposed in foreign applications with the right of priority claiming based on Japanese Patent Application No. 63-194063 a sensing system in which a high temperature gas or vapor such as steam gas generated from a heated material as heating progresses, is drawn out through a vent hole formed in the wall of a heating chamber and brought into contact with a pyroelectric element provided outside of the heating chamber so as to sense the finish of the heating in accordance with a voltage produced by the pyroelectric element In this type of sensing system, the sensing mechanism is based on a physical phenomenon of heat transfer from steam to the pyroelectric element. Thus, the sensitivity is not changed greatly due to the contamination of the surface of the element unlike the conventional humidity sensors, resulting in an advantage that it is theoretically possible to provide a very simple sensing system.

This system, however, has an inherent defect as well such that long-time cooking causes the temperature of the pyroelectric element itself to rise and, as a result, the difference in the temperature between the pyroelectric element and the steam generated from the food becomes small, resulting in a lowering of sensitivity. To cope with this, it is required to use the pyroelectric element while cooling it as suggested in the above-mentioned foreign applications, and, in addition, it is required to develop an efficient sensing system at low cost which is commercially available.

SUMMARY OF THE INVENTION

The present invention aims at eliminating the above-described problems of the prior art and is constructed such that steam gas generated from a heated material in a heating chamber is stably and quickly drawn out from a heating chamber and, after making contact with a sensor means, is discharged to the outside of the apparatus. It is therefore an object of the present invention to provide an automatic heating apparatus which can quickly sense, by means of a sensor means any increase or decrease in the amount of steam gas caused by a change in the state of a heated material, thus realizing a good finish of the heated material.

In order to achieve the above object, a suction means is provided for drawing out the steam gas from the heating chamber quickly and stably. The suction means utilizes the fact that the pressure of air is increased when the flow of air induced by a blower means including propeller blades is restricted by a heating means such as a magnetron. Provision of an air passage which runs from a region where the pressure is thus increased to the outside of the apparatus where the pressure is relatively low and which provides a small resistance, causes the air of an increased pressure to rush through the air passage having small air resistance. This rush of air serves to create in the air passage a region where the pressure is lower than that in the heating chamber, in accordance with Bornoulli theorem. The lower pressure region causes steam gas to be drawn out from the heating chamber. A guide passage is therefore connected to the suction means for guiding steam gas from the heating chamber. An exhaust passage which provides a small exhaust resistance is connected to the suction means for discharging the steam gas guided thereto through the guide passage. A sensor means for sensing the state of the temperature of the steam gas is exposed to any of the guide passage, exhaust passage and the air passage of the suction means while serving as a part of the wall of the passage.

The present invention will become more clear when the following description will be read with reference to the drawings.

DESCRIPTION OF THE PREFERRED EMBODIMENTS

The present invention will be described in detail with reference to FIGS. 1 and 2.

Figure 1:
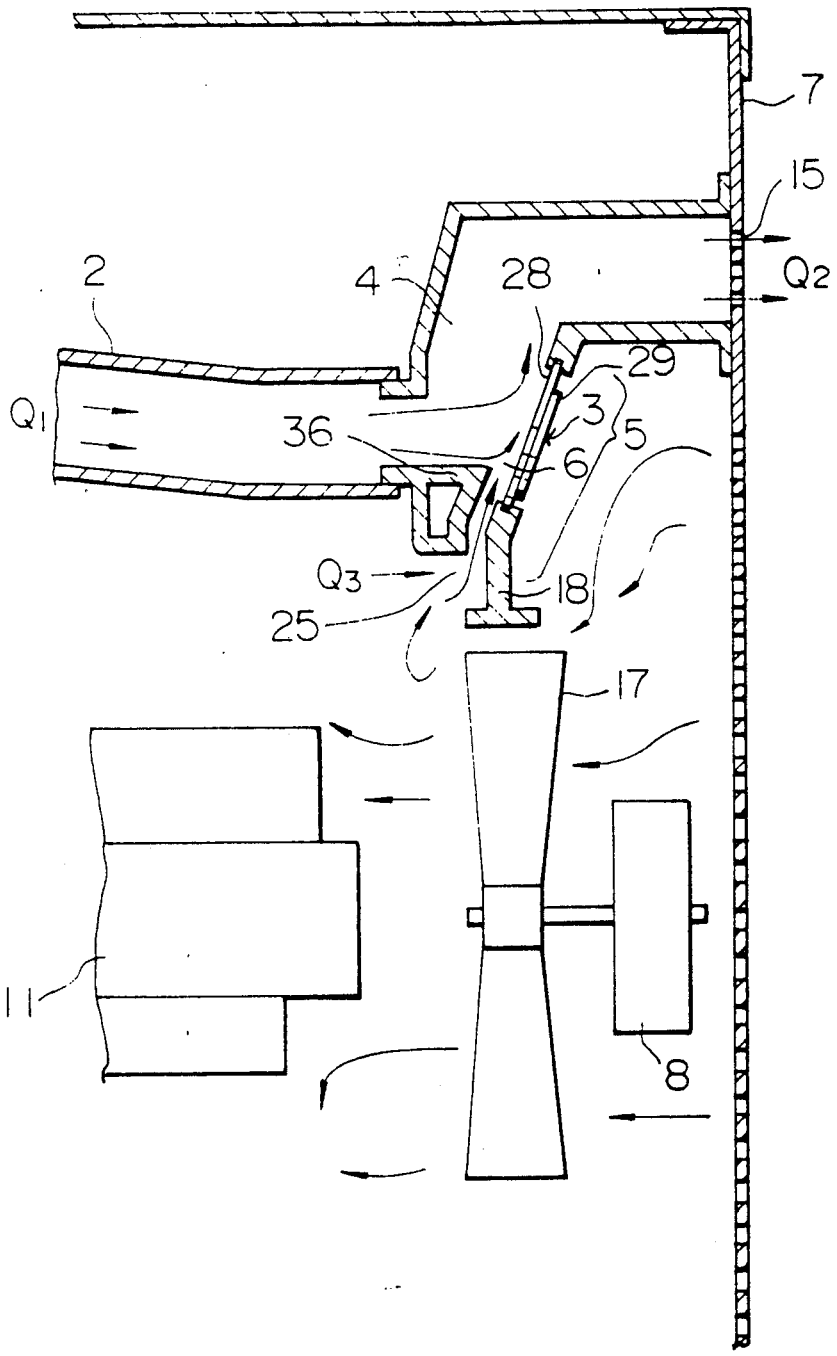
FIG. 1 is an enlarged sectional view of an embodiment of the present invention, showing essential portions thereof.
Figure 2:
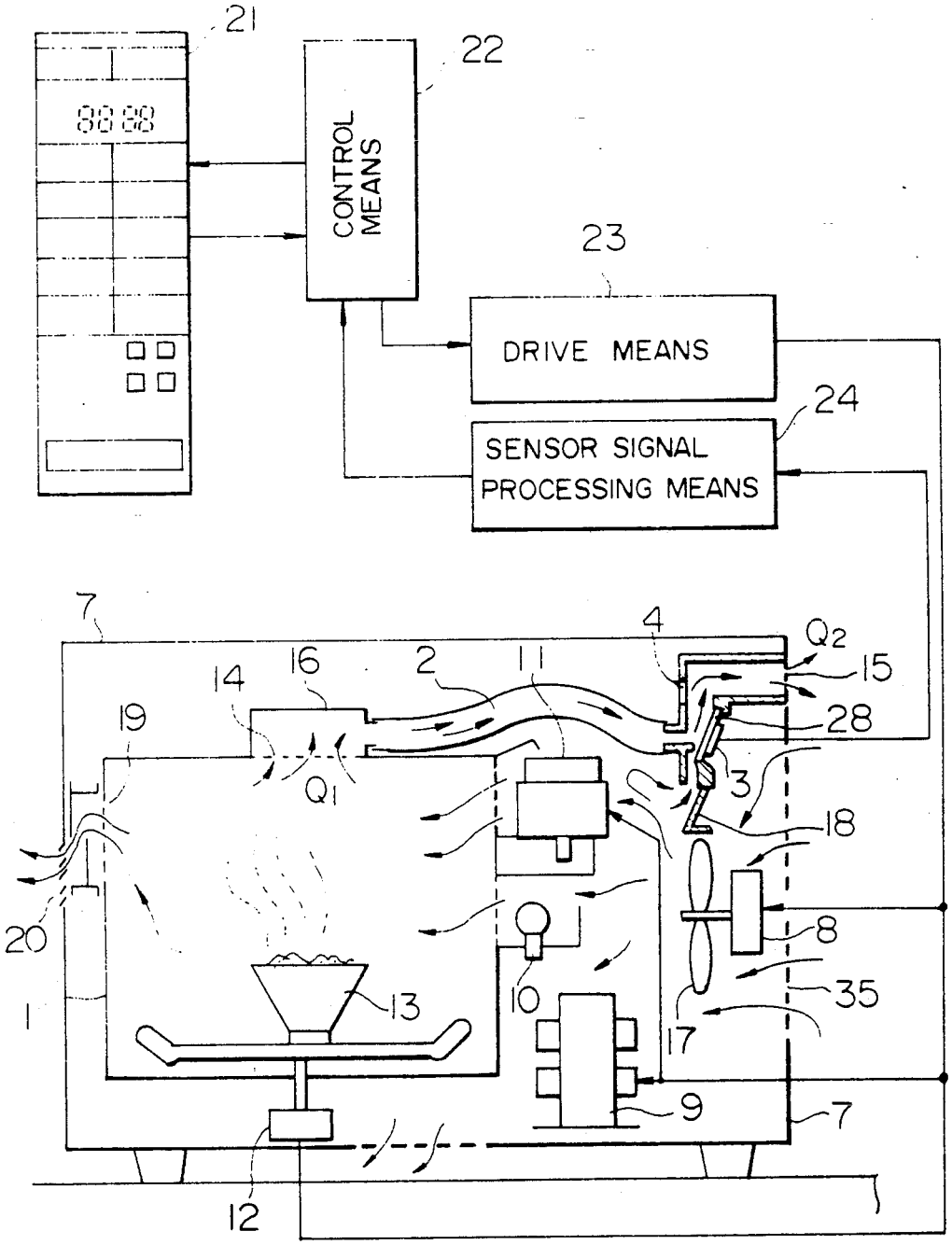
FIG. 2 is a block diagram showing functional components of the same embodiment.

As shown in FIGS. 1 and 2, a guide passage 2 which is connected to a heating chamber 1 and through which steam gas generated from a heated material is guided is connected to a negative pressure generating means 5. The negative pressure generating means 5 serves to produce a pressure lower than that in the heating chamber 1 so as to cause the steam gas in the heating chamber 1 to be drawn out. The negative pressure generating means 5 is also connected to an exhaust passage 4 through which the steam gas drawn out from the heating chamber 1 is discharged. An outlet 15 of an air passage of the negative pressure generating means 5, through which the exhaust air such as the steam gas flows out, is formed in a shell 7 of the apparatus. A sensor means 3 for sensing the state of heating of the heated material is provided, and serves as a part of the wall of the air passage of the negative pressure generating means 5.

The negative pressure generating means 5 makes use of the fact that the pressure of air is increased when a flow of air induced by a blower means including propeller blades 17 is restricted by a heating means such as a magnetron 11. An air passage which gives a small air resistance is provided so as to run from an inlet 25 of the negative pressure generating means 5 located in a region where the pressure is thus increased to the outside of the apparatus where the pressure is relatively low, so that air of the increased pressure rushes through the air passage having small air resistance, and then is discharged through the outlet 15 of the negative pressure generating means 5. This rush of air serves to create in the air passage a negative pressure region 6 where the pressure is lower than that in the heating chamber 1, as explained by the Bernoulli theorem. The negative pressure region 6 causes the steam gas to be drawn out from the heating chamber 1. For this reason, the guide passage 2 is connected to the negative pressure generating means 5 for guiding the steam gas from the heating chamber 1. The exhaust passage 4 which gives a small exhaust resistance is connected to the negative pressure generating means 5 for discharging the steam gas guided thereto through the guide passage 2. The sensor means 3 for sensing the state of temperature of the steam gas is exposed to the exhaust passage 4 or the air passage of the negative pressure generating means 5 while serving as a part of the wall of the passage.

Figure 3:
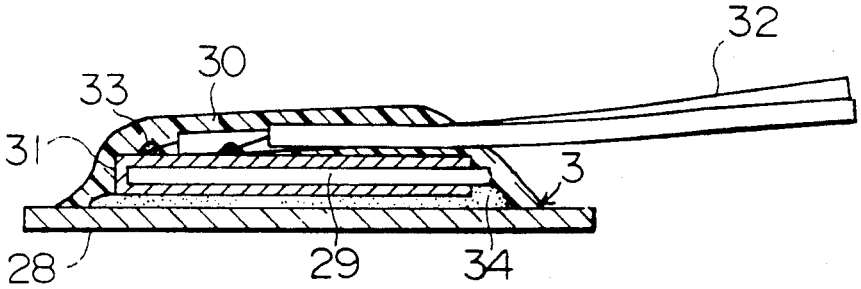
FIG. 3 is a sectional view of a sensor means according to the present invention.
Figure 4:
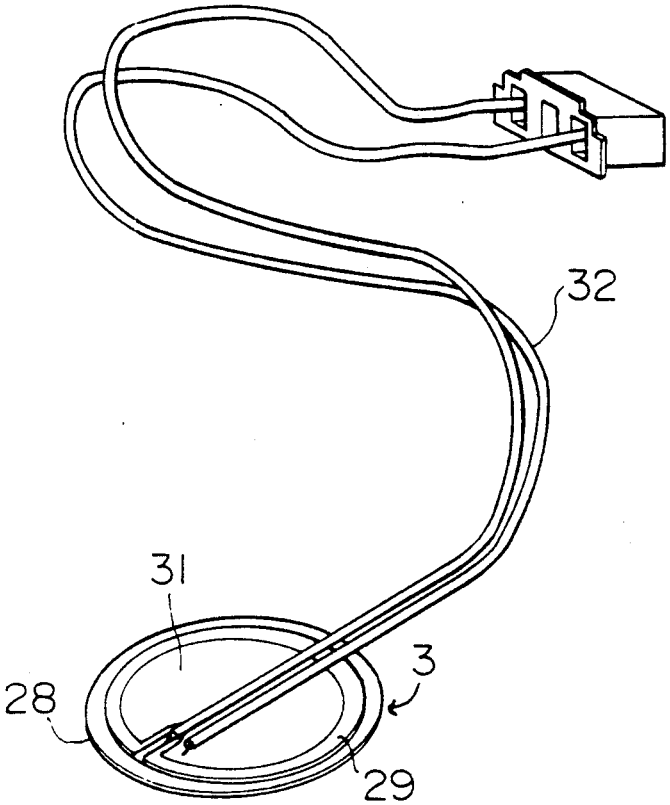
FIG. 4 is a perspective view of the same sensor means.
Figure 5:
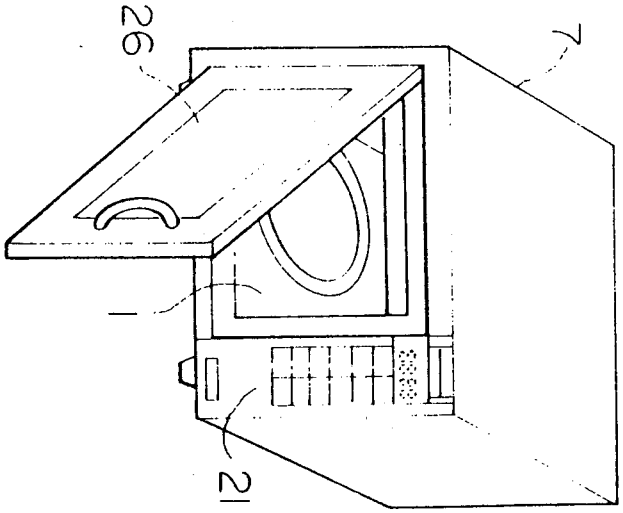
FIG. 5 is a perspective view of an automatic heating apparatus according to the present invention.

The sensor means 3 will be described with reference to FIGS. 3 and 4. The sensor means 3 exhibits pyroelectricity whereby the sensor means 3 produces a signal voltage in response to an instantaneous change in the temperature. Pyroelectricity can be produced by charges which are distributed on the surface of a dielectric member due to internal polarization of the latter. Namely, when a dielectric member which has been subjected to internal polarization experiences an abrupt change of temperature by being irradiated with heat carried by light, infrared radiation, steam gas of boiling water or the like or exposed to cold air to be cooled, the internal polarization of the dielectric member is extinguished so that the charges remain only on the surface of the dielectric member. This condition gives the pyroelectricity. It is possible to utilize the charge remaining on the surface by connecting this dielectric member to an electrical circuit. This element is generally referred to as a "pyroelectric element".

A certain type of pyroelectric element also has piezoelectric properties, and includes a piezo-electric ceramic used for a piezoelectric buzzer or a supersonic vibrator, a filmy polyvinylidene fluoride or the like.

Since the amount of charge on the pyro-electric element is proportional to the surface area thereof, the, larger the surface area, the greater is the ability of the element to sense a change in temperature.

The pyroelectric element can sense the signals effectively when it is formed in such a shape that is capable of collecting the maximum amount of charge, that is, in the shape of a plate which can ensure a large area by being provided thereon with parallel opposed electrodes.

In order to transmit the value of the charge on these surfaces to an electrical circuit, it is necessary to arrange an electrode in the direction corresponding to the direction of polarization. An electrode 31 is arranged covering the opposite sides of a plate pyroelectric element 29 such as a piezoelectric ceramic. A lead wire 32 is connected to the electrode 31 by soldering at a point 33. The pyroelectric element 29 is stuck to a metallic plate 28 by an adhesive 34. The pyroelectric element 29, the electrode 31 and the like are coated with a resin film 30 in order to avoid exposing them to the atmosphere. The pyroelectric element 29 and the metallic plate 28 are formed in a shape similar to a circle in order to minimize affection by a difference in the heat transfer coefficient and the thermal expansion coefficient The thinner the plate pyroelectric element 29, the higher the efficiency of the sensing signal is, but the deformation strength becomes lower A material which is hard to deform, such as a piezoelectric ceramic, is likely to crack when a moderate force is applied thereto. This weak point can be improved by employing material which is hard to crack, such as the metallic plate 28.

Description will be given below with reference to FIGS. 1 and 2.

The metallic plate 28 of the sensor means 3 is not disposed horizontally; rather it is inclined so that the steam gas is made to flow down in the form of water droplets even if condensed into dew drops. Such construction enables the stream of the steam gas to flow without any hindrance.

The air passage of the negative pressure generating means 5, the inlet 25 of which is located at a position where the flow of cooling air for cooling the magnetron 11 (which functions as the heating means) is restricted, leads to a vent hole formed in the shell 7 of the apparatus. This air passage has a smaller ventilating cross-sectional area at the inlet 25 than at the vent hole in the shell which serves as the outlet 15. This air passage therefore gives a small air resistance.

A blower means for supplying cooling air to the magnetron 11 (function as the heating means) is arranged between vent holes 35 through which air is sucked from the outside of the apparatus by means of a motor 8 provided with the propeller blades 17 and a heating section including the magnetron 11 a high-voltage transformer 9 and the like, so as to supply cold air to the heating section.

A partition 18 is provided in the vicinity of the propeller blades 17 for setting the direction of air flow, so that the region of blown air is separated from the region of the sucked or intake air.

The air passage of the negative pressure generating means 5 is designed to have a greater ventilating cross-sectional area in the region close to the outlet 15 than in the region close to the inlet 25, u resulting in a condition in which the air passage provides a larger air resistance in the region in the vicinity of the outlet 15 than in the region in the vicinity of the inlet 25.

The guide passage 2 through which the steam gas generated from the heated material 13 in the heating chamber 1 is guided is connected to the air passage of the negative pressure generating means 5 at a position in the vicinity of the inlet 25 where the ventilating cross-sectional area is small. Therefore, the guide passage 2 is connected to the air passage at a position where the air flows at a high velocity. The region where the air flows at a high velocity becomes the negative pressure region 6 so as to allow the steam gas to be drawn out from the guide passage 2.

The steam gas drawn out from the heating chamber 1 and the high velocity air which creates a negative pressure in the negative pressure generating means 5 are mixed together and the thus mixed gas is discharged to the outside of the apparatus. The exhaust passage through which the thus-mixed gas flows has a ventilating cross-sectional area which is greater than the total cross-sectional area which is the sum of the ventilating cross-sectional area of the air passage of the negative pressure generating means 5 at the inlet 25 and the ventilating cross-sectional area of a vent hole at the juncture between the guide passage 2 leading from the heating chamber 1 and the air passage, serving as the negative pressure generating means 5, thereby preventing the resistance to the air flow from increasing in the exhaust passage.

A surface of the metallic plate 28 of the sensor means 3 exposed to the guide passage 2 or the exhaust passage 4 constitutes a part of the wall thereof. Therefore, since the steam gas does not come in direct contact with the pyroelectric element 29, it is possible to prevent the sensor means 3 from erroneously operating as a result of deterioration of the insulation. Further, since the steam gas comes in contact with the metallic plate 28, any change in the heat of the steam gas can be transmitted to the entire surface of the pyroelectric element 29.

Even if the sensor means 3 is fixed to any of the guide passage 2, the exhaust passage 4 and the air passage of the negative pressure generating means 5, the portion with which the sensor means 3 comes in contact has to be an electrical insulator. This portion also serves as a heat insulator. It is therefore possible to prevent leakage of the charge on the sensor means 3 and to sense the state of heating of the heated material 13 accurately. Since the sensor means 3 is enclosed by a heat insulator, only the heat of the steam gas in the air is transferred to the sensor means 3, with the result that the change of state can be sensed accurately and suitably in accordance with the state of heating of the heated material 13.

The negative pressure generating means 5 is provided with a projection 36 or an air passage wall member so that the ventilating cross-sectional area of the air passage in the region in the vicinity of the inlet 25 of the air passage is made smaller than that of a vent hole at the juncture between the guide passage 2 leading from the heating chamber 1 and the air passage of the negative pressure generating means 5, giving rise to a vortex flow in the negative pressure region 6 which is created when the high velocity air supplied through the inlet 25 passes through the air passage Due to this vortex flow, the steam gas from the heating chamber 1 and the high velocity air are mixed together, that is the steam gas is diffused in the air passage of the negative pressure generating means 5. The steam gas thus diffused is made to come in contact all over the metallic plate 28 of the sensor means 3. Since the steam gas is made to come in contact all over the metallic plate 28 in this way, the sensor means 3 can sense the change of state in accordance with the change in the state of heating of the heated material 13.

In the negative pressure generating means 5, the metallic plate 28 as a heat receiving surface of the sensor means 3 is arranged in the wall of the air passage at a position which is opposed to the vent hole at the juncture between the guide passage 2 leading from the heating chamber 1 and the air passage and which is located on the outlet 15 side. Therefore, the steam gas from the heating chamber 1, which is mixed with the high velocity air is driven away by the high velocity air while making contact with the metallic plate 28, whereby dew drops stuck to the metallic plate 28 are blown away or dried. Accordingly, the metallic plate 28 can be maintained in the state where a change in the heat of the steam gas is easily transferred thereto The sensor means 3 is arranged to serve as a part of the wall of the air passage of the negative pressure generating means 5 and a part of the wall of the guide passage 2 leading the heating chamber 1. Since the sensor means 3 is planar, one of the surfaces of the sensor means 3 serves as the wall of the air passage of the negative pressure generating means 5 and the other surface thereof serves as the wall of the guide passage 2, resulting in that one of the surfaces of the sensor means 3 is continuously exposed to the high velocity air and the other to the steam gas induced from the heating chamber 1. The heat of the elevated temperature steam gas is transmitted to the cold pyroelectric element 29 of the sensor means 3. The steam gas reaches the sensor means 3 before it is mixed with the high velocity air so as to lower its temperature. It is therefore possible to realize the signal detection with high sensitivity in accordance with a change in the state of the steam gas.

The surface of the metallic plate 28 of the sensor means 3 is arranged to serve as the wall surface of the guide passage 2 through which the steam gas induced from the heating chamber 1 is guided, and the pyroelectric element 29 of the sensor mean 3 is arranged to serve as the wall surface of the air passage of the negative pressure generating means 5. Therefore, the steam gas comes in contact with the surface of the metallic plate 28 so that a change in the temperature of the steam gas can be easily transmitted to the entire pyroelectric element 29. Further, since the steam gas does not reach the pyroelectric element 29, the electrical insulation can be maintained, and since the pyroelectric element 29 is in contact with the high velocity air at all times, the pyroelectric element 29 can be cooled quickly even if the heat of the steam gas is transmitted thereto Accordingly, a change in the temperature of the steam gas can be sensed accurately in a stable manner, and, even if the heated material 13 is heated repeatedly, the heat of the residual steam generated by the preceding heating can be cooled quickly. As a result, there is no problem that a change in the temperature of the steam gas generated from the heated material 13 is sensed incorrectly due to the influence of the heat of the residual steam.

Description will now be given of the operation of an automatic heating apparatus with reference to FIGS. 1 to 5.

A door 26 is attached to the heating chamber 1 of the automatic heating apparatus. A control panel 21 is disposed by the side of the door 26, to which control commands for controlling the operation of the automatic heating apparatus are inputted.

A turntable on which a material 13 to be heated is adapted to be placed is provided in the heating chamber 1. The turntable is rotated by a turntable motor 12. The material 13 is heated with an electromagnetic wave supplied from the magnetron 11 as the heating means. A lamp 10 emits light onto the heated material 3 through an opening formed in the wall of the heating chamber 1. The magnetron 11 is supplied with an electric power by a high-voltage generating means such as the high-voltage transformer 9. A blower means which produces streams of cooling air for cooling the high-voltage transformer 9, the turntable motor 12, the magnetron 11 as the heating means and the like, comprises the propeller blades 17 and the motor 18.

A heating process is commenced by setting the heated material 13 in the heating chamber 1 and depressing a heating start instruction key after selection of a desired automatic heating function on the menu listed on the control panel 21. The commencement of the heating process means that a control unit starts a predetermined operation in accordance with the inputted data delivered from the control panel 21. More specifically, a control signal is sent from the control unit 22 to a driving means 23 so that the turntable motor 12, the high-voltage transformer 9, the magnetron 11, the lamp 10 and the motor 8 of the blower means are activated. Simultaneously with the start of heating, the air used for cooling the magnetron 11 and the lamp 10 is compelled to enter the heating chamber 1 due to the pressure of air driven out by the propeller blades 17. The air entered into the heating chamber 1 is allowed to flow out from exhaust openings formed in the wall of the heating chamber 1. In the present invention, the air is allowed to flow out of the heating chamber 1 from two exhaust openings, that is, an exhaust opening 19 having a sufficiently large ventilating cross-sectional area and another exhaust opening 14 having a smaller ventilating cross-sectional area. Thus, most of the exhaust air is discharged to the outside of the apparatus via the exhaust opening 19 having a greater ventilating cross-sectional area and a discharge port 20. On the other hand, the remaining small part of the exhaust air containing the steam gas is drawn out through the exhaust opening 14 of the smaller ventilating cross-sectional area by means of the negative pressure generating means 5. The steam gas drawn out through the exhaust opening 14 is caused to pass through an exhaust guide 16 and the guide passage 2 and reach the negative pressure region 6 in the air passage of the negative pressure generating means 5. Then a change in the temperature of the steam gas responding to the state of heating of the heated material 13 is transmitted to the sensor means 3 provided on the wall along which the steam gas flows.

Meanwhile, the flow of air driven out by the propeller blades 17 is restricted by the magnetron 11 as the heating means, so that the pressure of air in the region between the magnetron 11 and the propeller blades 7 is increased. The air passage of the negative pressure generating means 5 is provided such that the inlet 25 is located in this increased pressure region and the outlet 15 is located in a region where the pressure is equal to the pressure of the air outside the apparatus. With this arrangement, the cold air flows vigorously from the inlet 25 in the higher pressure region toward the outlet 15 in the region where the pressure is equal to the pressure of the air outside the apparatus. In this region where the air flows vigorously, a negative pressure is generated in accordance with the Bernoulli theorem.

Owing to the generation of the negative pressure by this vigorous air flow, the steam gas is drawn out from the heating chamber 1. The steam gas thus drawn out and the flow of the cold air are mixed together and discharged to the outside of the apparatus through the exhaust passage 4. The exhaust passage 4 includes the outlet 15 of the air passage of the negative pressure generating means 5.

A change in the temperature of the steam gas which is sensed by the sensor means 3 disposed on the wall of the passage leading from the guide passage 2 to the air passage of the negative pressure generating means 5 or the exhaust passage, is processed by a sensor signal processing means 24 so as to be changed into a desirable signal form and, thereafter, delivered to the control unit 22. This signal processing means includes a low-pass filter circuit, a high-pass filter circuit, an amplifier circuit, a wave detector circuit and the like, which serves to amplify a pulse signal attributable to the fluctuation of the temperature change of the steam gas while maintaining the low frequency.

Figure 6:
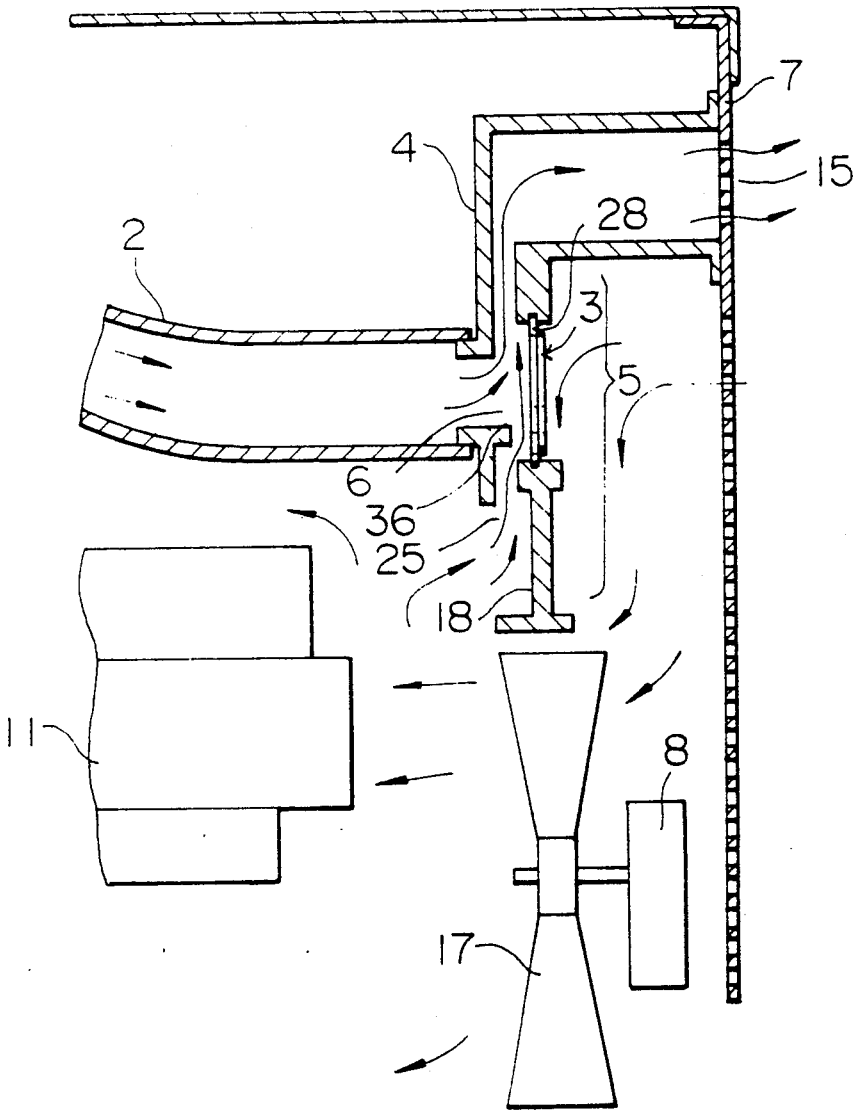
FIGS. 6 to 8 are enlarged sectional views of other embodiments of the present invention, showing essential portions thereof.

FIG. 6 shows another embodiment of the present invention. In this embodiment, the air passage of the negative pressure generating means 5 is made narrow so that a vortex flow of air produced by a projection 36 provided in the vicinity of the inlet 25 is allowed to easily reach the metallic plate 28 of the sensor means 3. This vortex flow of air creates the negative pressure region 6, causing the steam gas to be drawn out from the heating chamber 1 and, at the same time, mixes the steam gas and the cold air flowing together at a high velocity.

Figure 7:
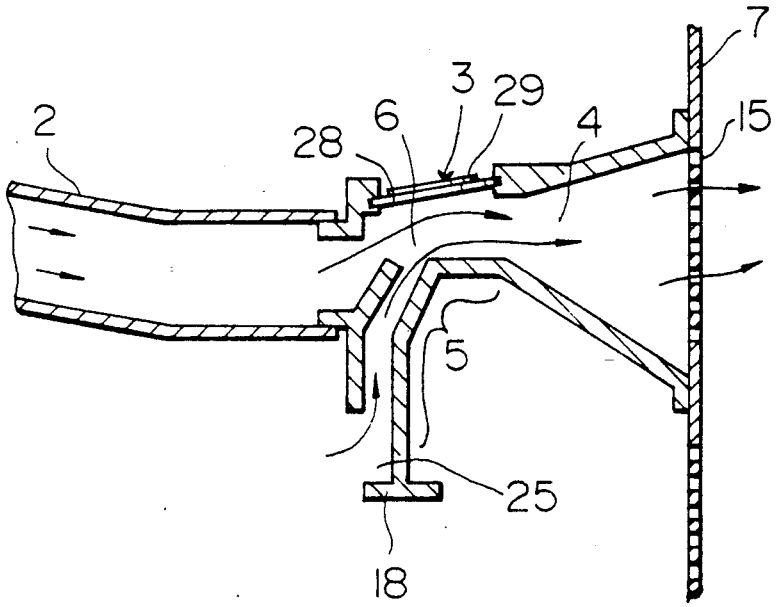

FIG. 7 shows still another embodiment of the present invention. In this embodiment, steam gas drawn out by virtue of the negative pressure region 6 which is produced by the air flowing at a high velocity through the air passage of the negative pressure generating means, and the high velocity air are made to flow in parallel with each other so that a layer of steam gas is allowed to flow along-side of the metallic plate 28 of the sensor means 3. In this way, only a part of the steam gas layer which is not mixed with the high velocity air is made to come in contact with the metallic plate 28 of the sensor means 3, thus ensuring transmission of a signal indicative of the heat possessed by the steam gas without causing any drop in the temperature. Accordingly, a change in the temperature of the heated material 13 in the heating chamber 1 can be sensed with high sensitivity.

Figure 8:
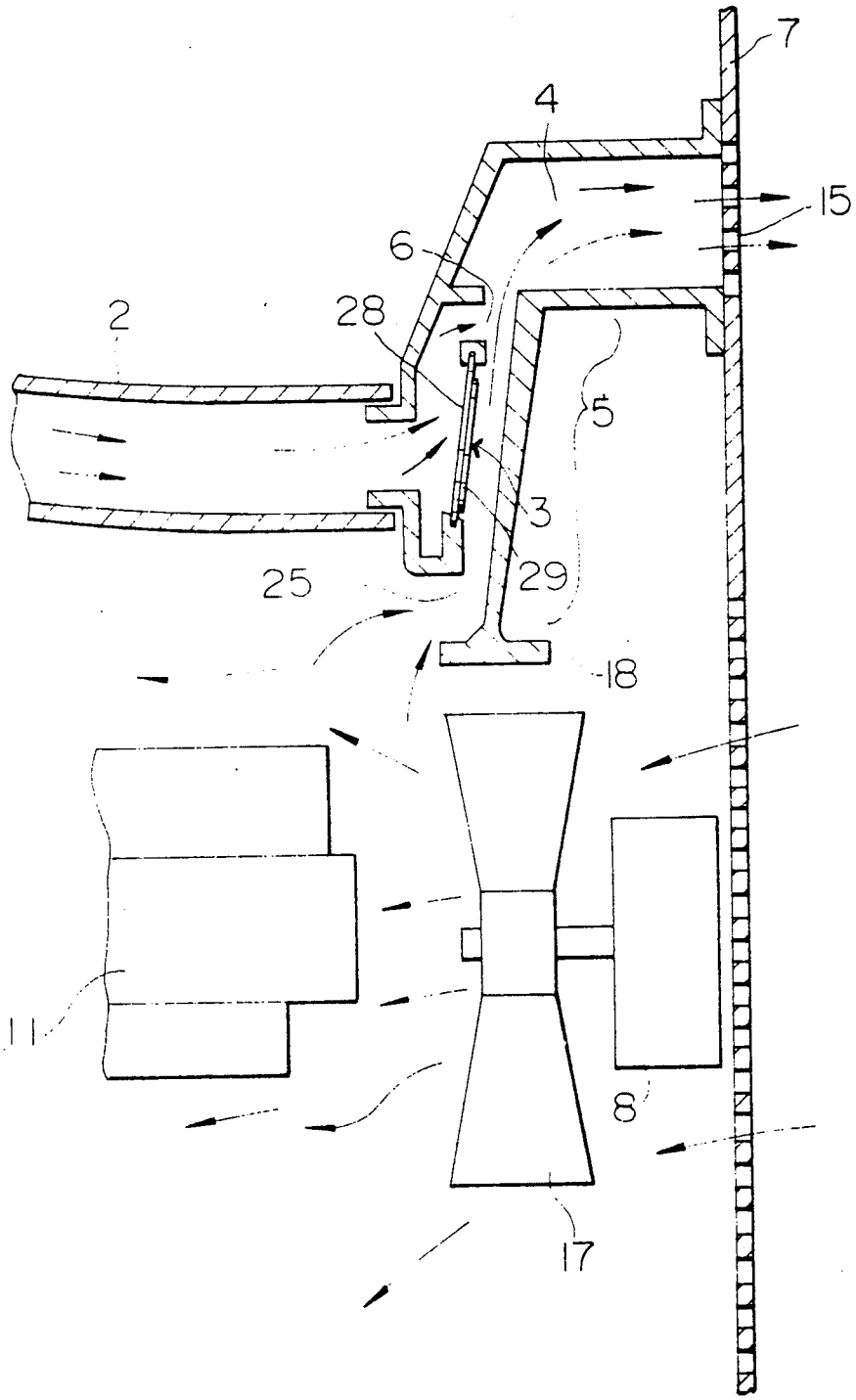

FIG. 8 shows a further embodiment of the present invention. In this embodiment, a planar surface of the pyroelectric element 29 of the sensor means 3 is arranged in the air passage of the negative pressure generating means 5 to serve as a part of the wall of the air passage for air flowing at a high velocity, and a planar surface of the metallic plate 28 opposite to the pyroelectric element 29 is arranged to serve as a part of the wall along which the steam gas from the guide passage 2 flows. Namely, the sensor means 3 is provided as a boundary wall between the air passage for the high velocity air and the guide passage 2 which are adjacent to each other. With this arrangement, the pyroelectric element 29 is constantly exposed to the cold air flowing at the high velocity, and therefore, even if heat caused by a change in the temperature of the steam gas is transmitted to the pyroelectric element 29, it is removed at once without being stored. Since heat is not accumulated in the pyroelectric element 29, the temperature of the pyroelectric element 29 can be kept at a lower level although the heating apparatus is repeatedly used. Since the temperature of the pyroelectric element 29 can be kept at the lower level, a change in the state of heating of the heated material 13 can be sensed accurately by the sensor means 3 in a stable manner.

Other effects of the described embodiments of the present invention are as follows.

Since the sensor means is provided to serve as a part of the wall of the air passage of the negative pressure generating means, the exhaust passage or the guide passage it is possible to prevent the sensor means from giving resistance to air flow in each passage. Thus, a negative pressure can be produced stably so as to cause the steam gas to be drawn out quickly.

The sensor means employs a pyroelectric element having a planar shape which can provide a planar surface having a large area to which heat possessed by the steam gas is transmitted. The large heat receiving area contributes to an improvement in the sensitivity with which a change in the heat of the steam gas is sensed.

Since the pyroelectric element of the sensor means is bonded to the metallic plate, a change in the heat of the steam gas can be transmitted to the entire pyroelectric element in a moment. This contributes to quick sensing of a change in the temperature of the steam gas. Further, the pyroelectric element is reinforced by the strength possessed by the metallic plate so as to have a high deformation resistance.

Since the heating means is disposed at a position where the flow of air for cooling the heating means is restricted, the air flow resistance is increased and air is compressed by the blower means, resulting in an increased pressure.

Since the air passage has a larger ventilating cross-sectional area at the outlet than at the inlet, the exhaust resistance is made smaller in this air passage.

Since the blower means includes the propeller blades 17, the region of blown air and the region of drawn air are partitioned apart by the propeller blades 17, thus assuring the increase of the pressure of the blown air.

Since the air passage has a greater ventilating cross-sectional area in the region around the outlet than in the region around the inlet, the air passage gives a smaller exhaust resistance in the vicinity of the outlet than in the vicinity of the inlet.

Air having an increased pressure flows vigorously into the air passage through the small and narrow inlet and, then, flows toward the exhaust passage in which the pressure is lower than that in the region in the vicinity of the inlet. As a result, air flows at a higher velocity in the region of the air passage in the vicinity of the inlet where the pressure is lower than that in the heating chamber. Thus, the guide passage is connected to the air passage at a position located in the vicinity of the inlet where the pressure is reduced.

Since the ventilating cross-sectional area of the exhaust passage is greater than the sum of the two cross-sectional areas, that is, the ventilating cross-sectional area of the air passage at the inlet and the cross-sectional area of the vent hole at the juncture between the guide passage and the air passage, the air passage gives a smaller exhaust resistance in the vicinity of the outlet than in the vicinity of the inlet.

Since the metallic plane of the sensor means is exposed to the guide passage or the exhaust passage, a change in the temperature of the steam gas can be quickly propagated over the entire pyroelectric element and sensed in a stable manner. Further, the pyroelectric element is prevented from coming in direct contact with the steam gas, thus preventing any deterioration of insulation attributable to sticking of water droplets.

The guide passage, the exhaust passage and the air passage, to any of which the sensor means can be fixed, are formed by the electric insulators. This contributes to the prevention of the leakage of current from the electrical signals produced by the sensor means even if the sensor element is fixed to any passage. Further, since the electric insulator also serves as the heat insulator, the heat transmitted from the steam gas to the passages is prevented from being transmitted to the sensor means. Accordingly, the signal indicative of the steam gas sensed by the sensor means corresponds only to a change in the temperature sensed by the sensor means.

Since the metallic plate of the sensor means is not horizontal but inclined, dew drops formed by condensation of the steam gas on the metallic plate are caused to flow down. Further, since the dew drops on the metallic plate do not cover the entire surface of the metallic plate, the steam gas is allowed to come in contact with the exposed metallic plate at all times Since the projection or the air passage wall member is provided in such a manner that the cross-sectional area of the air passage in the vicinity of the inlet is made smaller than that of the vent hole at the juncture between the guide passage and the air passage, the steam gas induced from the guide passage is caused to flow into the air passage along the projection. Thus, the steam gas is diffused into the air passage.

Since the heat receiving surface of the sensor means is arranged in the wall of the air passage at a position which is opposed to the vent hole at the juncture between the guide passage and the air passage, a mixture of the steam gas induced from the guide passage and the cold air flowing at the high velocity is brought into contact with the heat receiving surface of the sensor means.

A single sensor means is arranged to serve as both part of the wall of the guide passage and as part of the wall of the air passage, that is, the planar surface of the metallic plate of the sensor means is exposed to the guide passage and the planar surface of the pyroelectric element of the sensor means is exposed to the air passage. Thus, the pyroelectric element is cooled by the air flowing at high velocity and heat possessed by the steam gas maintained at elevated temperature can be transmitted through the metallic plate to the pyroelectric element.

What is claimed is:

1. An automatic heating apparatus, comprising:

a heating chamber located within a shell, said heating chamber receiving material to be heated;

heating means for heating said material thereby causing heated air to be emitted therefrom;

a guide passage connected to said heating chamber for receiving said heated air;

an exhaust passage, having an outlet, connected to said guide passage for discharging said heated air;

blower means for blowing cooling air into said shell;

negative pressure generating means including an air passage connected to said guide passage and having an inlet for receiving cooling air from said blower means, the pressure of the air at the inlet of said air passage being greater than that at the outlet of said exhaust passage thereby producing at the juncture of said air and guide passages a region wherein the pressure is lower than that within said heating chamber; and sensor means having a sensitive surface located in one of said guide, exhaust and air passages in the vicinity of said juncture, the sensitive surface of said sensor means being exposed to said heated air thereby providing a signal corresponding to a change in the temperature thereof; and control means connected to said heating, blower and sensor means, said heating means being controlled by the signal provided by said sensor means.

2. An automatic heating apparatus according to claim 1, wherein said sensor means has another surface opposite said sensitive surface, said another surface being exposed to cooling air blown by said blower means.

3. An automatic heating apparatus according to claim 1, wherein said heating chamber is provided with a horizontal surface on which said material to be heated is placed, and wherein the sensitive surface of said sensor means is inclined at an angle with respect to said horizontal surface.

4. An automatic heating apparatus according to claim 3 wherein the sensitive surface of said sensor means is substantially perpendicular to said horizontal surface.

5. An automatic heating apparatus according to claim 1, wherein said blower means cools said heating member; and wherein said negative pressure generating means includes a partition separating a region of intake air to said blower means from a region of air blown by said blowing means.

6. An automatic heating apparatus according to claim 5, which further includes an air passage wall member for limiting the cross-sectional area of the inlet to said air passage thereby increasing the pressure of the air at said inlet.

7. An automatic heating apparatus according to claim 5, wherein said sensor means is affixed to said partition.

8. An automatic heating apaprauts according to claim 1, wherein said sensor means includes a support member made of an electrically insulating material.

9. An automatic heating apapratus according to claim 1, wherein said sensor means includes a pyroelectric element.

10. An automatic heating apparatus, comprising:

a heating chamber located within a shell, said heating chamber receiving material to be heated;

heating means for heating said material thereby causing heated air to be emitted therefrom;

a guide passage connected to said heating chamber for receiving said heated air;

an exhaust passage, having an outlet, connected to said guide passage for discharging said heated air;

blower means for blowing cooling air into said shell;

negative pressure generating means including a partition separating a region of intake air to said blower means from a region of air blown by said blower means;

an air passage wall member, said partition and said air passage wall member defining an air passage connected to said guide passage and having an inlet for receiving cooling air from said region of blown air, the pressure of the air at the inlet of said air passage being greater than at the outlet of said exhaust passage thereby producing at the juncture of said air and guide passages a region wherein the pressure is lower than that within said heating chamber; and sensor means disposed within said partition in the vicinity of said juncture, said sensor means having a sensitive surface exposed to the heated air in said guide passage and a surface opposite thereto exposed to said intake air region thereby providing a signal corresponding to a change in the temperature of said heated air; and control means connected to said heating, blower and sensor means, said heating means being controlled by the signal provided by said sensor means.

11. An automatic heating apparatus according to claim 10, wherein said heating chamber is provided with a horizontal surface on which said material to be heated is placed, and wherein the sensitive surface of said sensor means is inclined at an angle with respect to said horizontal surface.

12. An automatic heating apparatus according to claim 11, wherein the sensitive surface of said sensor means is substantially perpendicular to said horizontal surface.

13. An automatic heating apparatus according to claim 10, wherein said blower means cools said heating member.

14. An automatic heating apparatus according to claim 10, wherein said sensor means includes a support member made of an electrically insulating material.

15. An automatic heating apparatus according to claim 10, wherein said sensor means includes a pyroelectric element.

* * * * *